United States Patent [19]

Arnstein

[11] 3,963,200

[45] June 15, 1976

[54] KITE WITH A DIVERGING WING STRUTS WITH A CENTER STRUT AND A CROSS-STRUT SECURED TO BOTH DIVERGING STRUTS AND THE CENTER STRUT

[76] Inventor: Bennett R. Arnstein, 3049 W. Eight St., Los Angeles, Calif. 90005

[22] Filed: Mar. 24, 1975

[21] Appl. No.: 551,215

[52] U.S. Cl. ..... 244/153 R; D34/15 AF

[51] Int. Cl.[2] ..... B64C 31/06

[58] Field of Search ..... 244/153 R; D34/15 AF

[56] References Cited

UNITED STATES PATENTS

| | | | |
|---|---|---|---|
| 1,105,058 | 7/1914 | Bochau | 244/153 R |
| 2,484,316 | 10/1949 | Simons | 244/153 R |
| 3,335,984 | 8/1967 | Holland | 244/153 R |
| 3,534,932 | 10/1970 | Christoffel et al. | 244/153 R |

*Primary Examiner*—Stephen G. Kunin
*Assistant Examiner*—Barry L. Kelmachter
*Attorney, Agent, or Firm*—Dominick Nardelli

[57] ABSTRACT

A kite is disclosed having a main body portion fabricated of a flexible material and having a pair of leading edges diverging generally rearwardly from a forward apex, with a strut fixed to each edge to hold it rigid. The body portion is folded to provide a central longitudinal double-ply pleat, and another central strut is disposed and fixed along the pleat. The pair of diverging struts each have a pocket wherein the respective end of a cross-strut is disposed. The cross-strut is secured to the central strut at the point where the two cross. For added strength with decreased weight the portions of the kite are held together with a suitable adhesive tape.

7 Claims, 9 Drawing Figures

FIG. 1
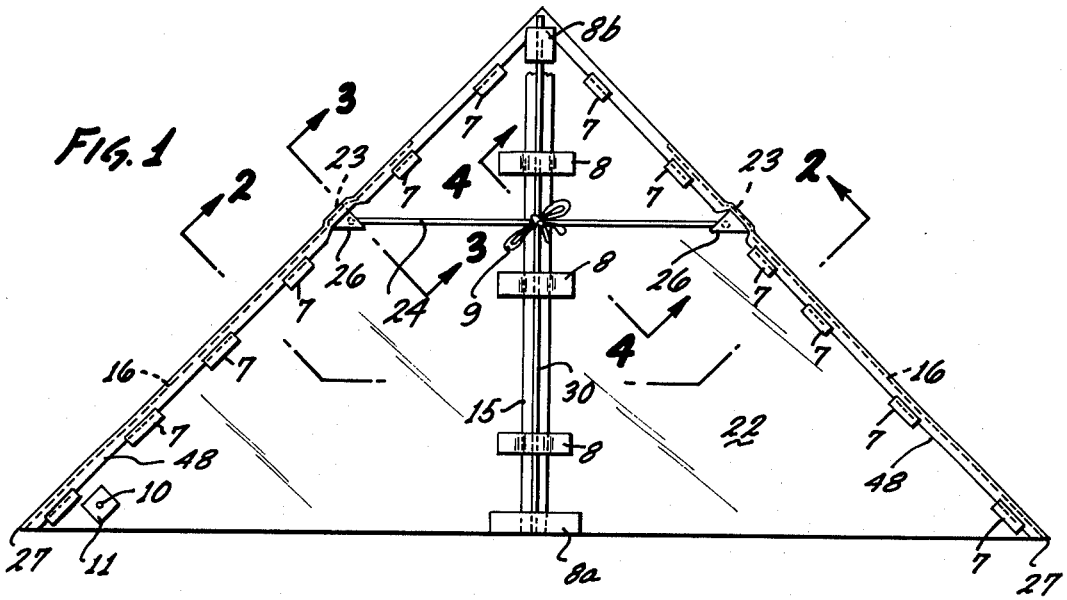
FIG. 2
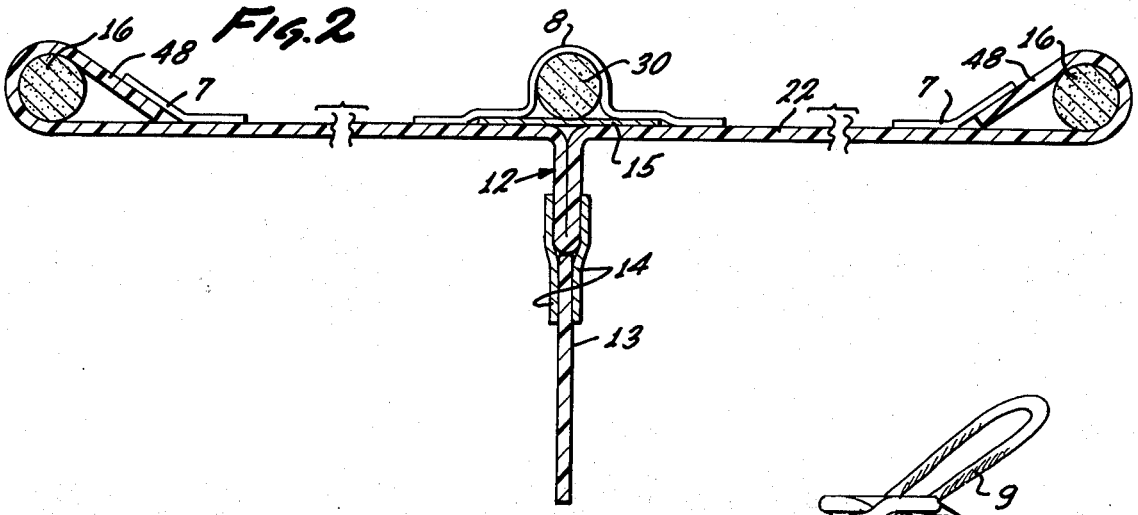
FIG. 3
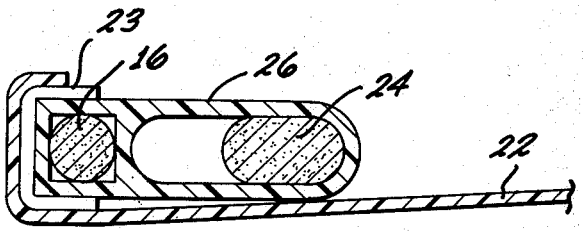
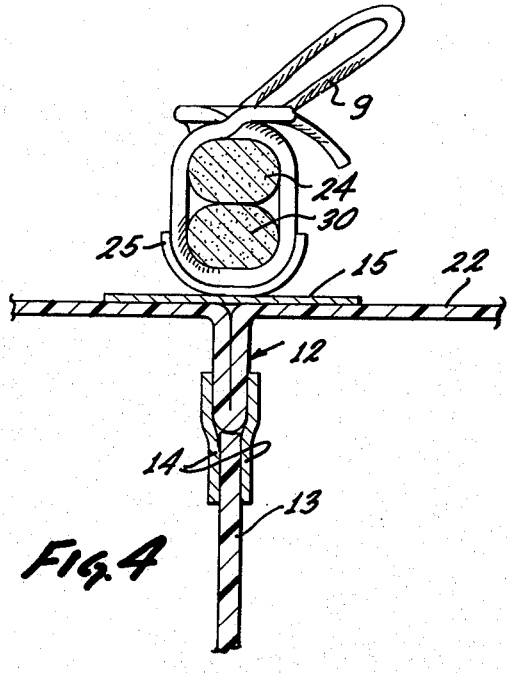
FIG. 4

KITE WITH A DIVERGING WING STRUTS WITH A CENTER STRUT AND A CROSS-STRUT SECURED TO BOTH DIVERGING STRUTS AND THE CENTER STRUT

Field of the Invention

This invention pertains generally to kites, of the tailless variety and, more particularly, to means for increasing flying height with decreasing string pull.

Background of the Invention

Prior art kites, such as taught in U.S. Pat. No. 3,534,932 and 3,347,500, have a cross-stick or cross-strut supported only at its ends, while it remains unsupported in the center. When the kite flies, the wind pressure against the body subjects the cross-stick to a compression load, for obvious reasons. This compression load increases with wind velocity. The cross-stick acts as a long slender column and deflects to assume a curved shape whenever the compression load is above a critical value. This causes the effective length of the stick to decrease which, in turn, decreases the effect of body surface area which, in turn, decreases the compression load on the cross-stick. When the compression load decreases, naturally the cross-stick tends to straighten. This again increases the effect of body surface area, and the process repeats itself and causes, in effect, an oscillation. The net effect on a kite is an increased pull on the flying string or an increased drag on the kite, and essentially no increase in altitude of the kite. Thus, no matter what the wind velocity is, within reasonable limits, no increase in kite altitude is obtained. Furthermore, the string breaking force should be increased to withstand the added drag, further decreasing altitude.

Objects of the Invention

An object is to provide a means added to the kite of the prior art that causes the kite to fly at a high altitude with less drag.

Another object is to provide an improved simple kite, capable of flying at higher altitudes.

Another object is to provide an improved kite wherein the drag is decreased.

These and other objects and features of advantage will become more apparent after studying the following description of my preferred embodiment of my invention, together with the appended drawings.

Brief Description of the Drawings

FIG. 1 is a top plan view of a kite incorporating my novel features.

FIG. 2 is an enlarged sectional view taken on bent line 2—2 in FIG. 1.

FIG. 3 is a partial enlarged sectional view taken on line 3—3 of FIG. 1

FIG. 4 is another partial enlarged sectional view taken on line 4—4 in FIG. 1

FIG. 6 is an enlarged plan view of one of the pair of wing struts removed from the kite, the other strut being similar.

Detailed Description of the Drawings

Figure 5:
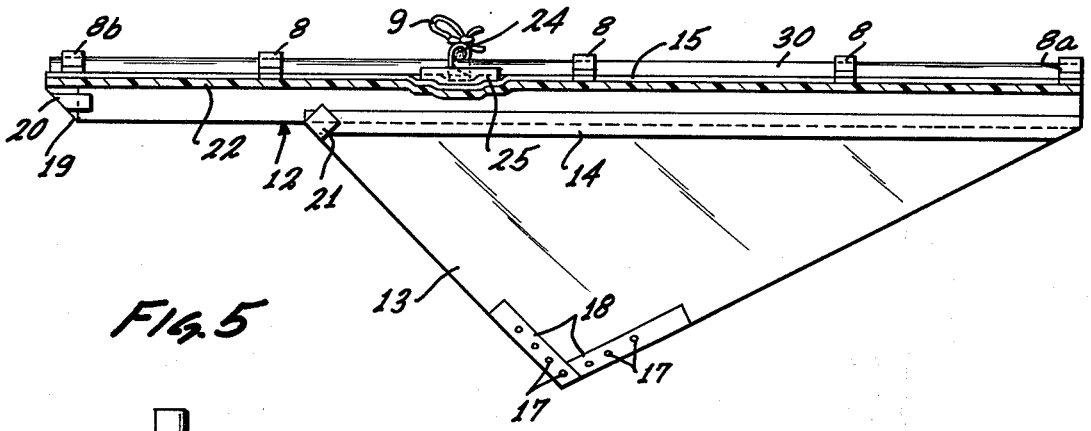
FIG. 5 is a longitudinal section of the kite, shown in FIG. 1, taken slightly off-center.

The preferred embodiment of my invention will be described, preferably in the manner one would tend to make the novel kite. The body 22 is cut to form a right triangle, essentially as shown in FIG. 1. The length of the hypotenuse of the triangle is, for example, 5 inches longer than the finished product. The body 22 is folded to bring the two legs of the right triangle alongside each other and then one side is folded until a pleat 12 is formed, which is about ¾ inch deep, as shown in FIGS. 2 and 4. To secure the pleat 12, a tape 15 is sealed against the body, as shown. The body should be symmetrical about the pleat. Since the forward portion of pleat 12 now extends in front of the finished kite apex, the forward tip 19 of the pleat is folded back and secured with a tape 20, as shown in FIG. 5. A keel 13 is cut from a polyethylene sheet to the desired shape, as shown in FIG. 5, and the keel is secured in butting relationship to the pleat 12 by a tape 14 on each side thereof, as shown in FIGS. 2 and 4. At the forward end of the keel 13, a bighted shaped tape 21 is secured to seal the spaces between the pleat 12, keel 13, and tapes 14, as shown in FIG. 5.

Figure 6:
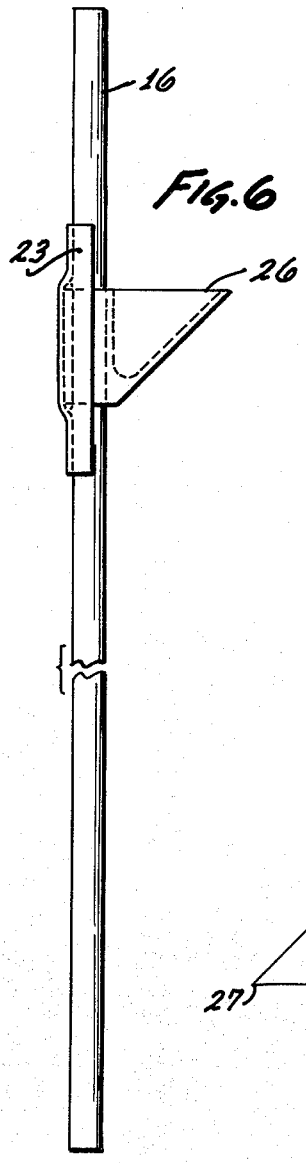
Figure 7:
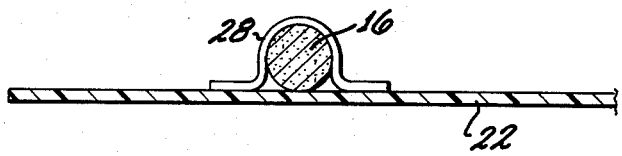
FIG. 7 is a partial section showing one of the primary steps for attaching a wing strut to the kite body.
Figure 8:
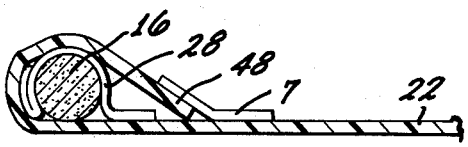
FIG. 8 is also a partial section showing the final attachment of the wing strut.

A pair of wing struts 16 are cut to length about 6% more than half the length of the hypotenuse of the body's right triangle. A wing cup 26 is fixed to each wing strut 16, as shown in FIG. 6, about 1/5th the length thereof from the end, and affixed with a tape 23. The wing cup 26 may be made the same as the cups disclosed in the above mentioned U.S. Pat. No. 3,534,932. Each wing strut 16 is secured to the body 22 by first lying down each strut inward, about 1 inch from the edge of the respective leg of the body triangle, and a plurality of short pieces of tape 28 are sealed transversely, as shown in FIG. 7 to form a wing flap 48. Each wing flap 48 is now folded over the respective wing strut 16 as shown in FIG. 8, and the edge thereof is sealed against the body 22 by a plurality of short tapes 7. No taping is placed over the cups 26, as shown in FIG. 1.

A cross-strut 24 is ready to be inserted in place, i.e., in the wing cups 26. The cross-strut 24 is preferably made ¼ inch shorter than a snug fit within the cups 26. The center strut 30 is placed over the tape 15 and under the cross-strut 24. The center strut 30 is placed as accurately in the center line as possible, and is marked where the cross-strut crosses it. A string 9 is secured to the center-strut at the marking by a tape 25, as shown in FIGS. 4 and 5. Then the center strut 30 is again placed over the tape 15 and under the cross-strut and secured in place by several pieces of tapes 8 disposed transversely to the strut 30. The strut 30 extends the full length of the kite, and the forward end is secured by a tape **8*b* and the rear end by a tape 8*a*. The string 9 is then tied over the cross-strut 24** securely.

Figure 9:
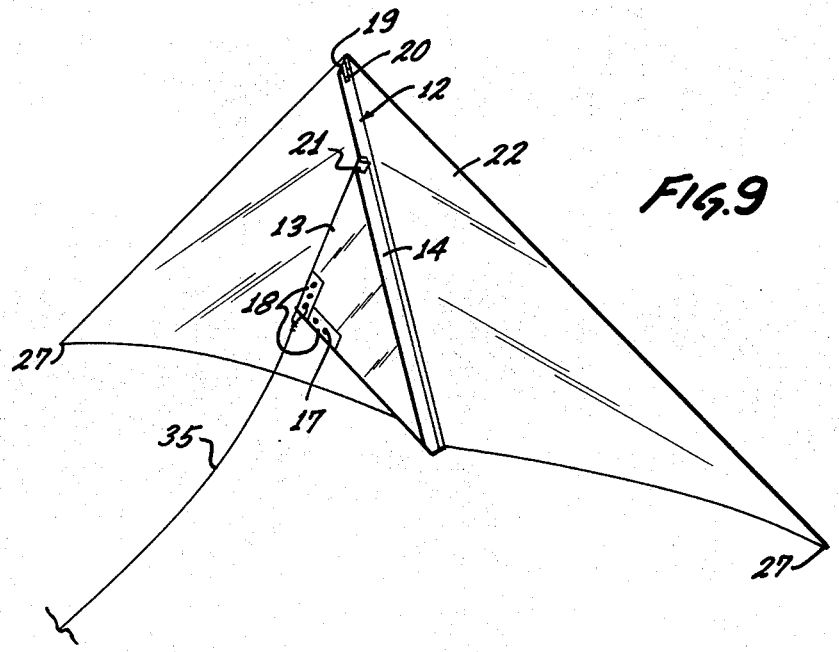
FIG. 9 is a pictorial view of the underside of the kite in flying position.

The keel is made ready for flying by adding reinforcing tapes 18 on both sides thereof, as shown in FIG. 5. Then several space grommets 17 are fixed, also as shown. A flying string 35 is secured to one of the grommets 17, as shown in FIG. 9. How to choose the correct grommet 17 is obtained by experience and depends on the wind conditions.

Before the first flight, the kite should be balanced, no matter how careful one is in assembling it. This is done indoors where the air is steady. With the cross-strut 24 in place, the string 9 is tied, as ready for flying. The kite is held by the tip of the keel 13 where the grommets 17 are located. The kite is allowed to hang free just above a level surface. When the kite is balanced, both wing tips 27 (FIG. 1) will be equally distant above the surface. Therefore to lower a tip 27, balance weight 10 is secured to the body 22 near that tip by a tape 11, as shown in FIG. 1. Naturally, the weight 10 is placed on the top side of the kite where the struts are located so as not to interfere with the streamlining. The preferred material for the various struts is wood, while the preferred material for the body is plastic. Tape is standard plastic adhesive tape and is preferred over sewing as it preserves the plastic, is cheaper than sewing, and also does not degrade the strength of the plastic. In addition, the body 22 can be made of two equal size right triangles. Then the pleat 12, instead of being a folded bighted section would be formed by two respective legs of the double triangle bodies in adjacent relationship to form an abutted pleat. Therefore, when the word pleat is used in this application, it refers to either the folded pleat or an abutted pleat.

Having described the preferred embodiment of my invention, one skilled in the art could devise other embodiments after studying the above disclosure. Therefore my invention is not to be considered limited to the disclosed embodiment, but includes all embodiments falling within the scope of the appended claims.

I claim:

1. A kite comprising:

a body of flat material symmetrical about a center line;

a pair of diverging wing struts secured to said body on opposite sides of said center line;

a center strut disposed on the center line of said body and secured thereto for substantially the full length of said center strut;

a cross-strut;

means on each diverging strut for receiving and securing the respective ends of said cross-strut so that said cross-strut is disposed substantially transverse to said body;

means for securing the center of said cross-strut to said center strut to provide additional stiffness to said cross-strut;

said body of said flat material having a pleat formed therein and disposed on the center line thereof;

said pleat being formed on the side of said body opposite said cross-strut and said center strut; and a keel portion being fastened to said pleat.

2. The kite of claim 1 wherein:

means are provided on one side of the center line of said body to balance the kite.

3. A kite comprising:

a body of flat material symmetrical about a center line;

a pair of diverging wing struts secured to said body on opposite sides of said center line;

a center strut disposed on the center line of said body and secured thereto for substantially the full length of said center strut;

a cross-strut;

means on each diverging strut for receiving and securing the respective ends of said cross-strut so that said cross-strut is disposed substantially transverse to said body;

means for securing the center of said cross-strut to said center strut to provide additional stiffness to said cross-strut;

said means for securing including a string bound around both said center strut and said cross-strut;

said body of flat material having a pleat formed therein and disposed on the center line thereof;

said pleat being formed on the side of said body opposite said cross-strut and said center strut; and a keel portion being fastened to said pleat.

4. The kite of claim 3 wherein:

means are provided on one side of the center line of said body to balance the kite.

5. The kite of claim 4 wherein:

said body and said keel are made of a plastic flexible sheet; and adhesive tape is used to secure said body to said struts and said keel to said pleat.

6. The kite of claim 5 wherein said struts are made of wood.

7. The kite of claim 6 wherein said keel is triangular in shape and includes many holes wherein to fasten a flying string.

* * * * *